United States Patent [19]

Frisbee

[11] 4,201,268

[45] May 6, 1980

[54] ADJUSTMENT MECHANISM FOR DOZER BLADE

[75] Inventor: Claude M. Frisbee, Bettendorf, Iowa

[73] Assignee: J. I. Case Company, Racine, Wis.

[21] Appl. No.: 953,827

[22] Filed: Oct. 23, 1978

[51] Int. Cl.[2] ..... E02F 3/76

[52] U.S. Cl. ..... 172/804; 172/805

[58] Field of Search ..... 172/801, 803, 804, 806, 172/807, 809, 805

[56] References Cited

U.S. PATENT DOCUMENTS

| | | | |
|---|---|---|---|
| 3,122,850 | 3/1964 | Rockwell | 172/803 X |
| 3,705,631 | 12/1972 | Seaberg | 172/804 |
| 3,773,116 | 11/1973 | Coontz | 172/804 |
| 3,774,696 | 11/1973 | Horsch | 172/804 |
| 3,913,684 | 10/1975 | Casey | 172/804 |

FOREIGN PATENT DOCUMENTS

| | | | |
|---|---|---|---|
| 287597 | 8/1971 | U.S.S.R. | 172/803 |

*Primary Examiner*—Richard J. Johnson

*Attorney, Agent, or Firm*—Cullen, Sloman, Cantor, Grauer, Scott & Rutherford

[57] ABSTRACT

A mechanism for angling, pitching, and tilting a dozer blade utilized in a conventional bulldozer wherein the blade is connected by means of a universal joint to the center bight portion of a C-shaped frame. A vertical mast support structure at the center of the bight portion of the frame mounts one end of the extensible links used for angling, tilting, and pitching the blade. The angling and pitching control includes a pair of piston-cylinders connected between the vertical mast and the respective sides of the bulldozer blade. The hydraulic circuitry for the cylinders simultaneously extends the piston rod of one cylinder while retracting the piston rod of the opposed cylinder to angle the blade about a vertical axis. Simultaneous extension or retraction of both piston rods causes the blade to pitch about a horizontal transverse axis. The blade is additionally connected to the top end of the vertical mast structure by a tilt cylinder which is disposed parallel to the top edge of the blade. The blade adjustment construction provides that when the blade is angled, the blade tilt is not changed. The present construction eliminates conventional complex push lever and linkage arrangements, and the operation does not require a complex hydraulic system.

12 Claims, 8 Drawing Figures

ADJUSTMENT MECHANISM FOR DOZER BLADE

BACKGROUND OF THE INVENTION

The present invention relates to bulldozers or the like having transversely extending material moving blades, and more particularly to an improved and simplified mechanism for angling, tilting, and pitching the material moving blade.

It is known to provide in bulldozers or similar types of earth working machines a pusher frame of C-shaped configuration which fits between the track frames or surrounds the front end of the tractor. The rear ends of the two arms of the C-shaped frame are pivotally connected to the sides of the tractor to permit raising and lowering of the C-shaped frame about a transverse axis thereby permitting lowering of the blade to a working position on the ground and raising of the blade for transport of the dozer tractor to another location.

In non-angling types of known bulldozer blade arrangements, tilting of the blade has been accomplished conventionally by pivotally connecting the back of the blade to the forward end of the push arms of a C-shaped frame and providing extensible and retractable braces or links between each push arm and the top of the blade. Tilting of the blade in this known construction is accomplished by retracting the brace or link on one push arm and at the same time extending the brace or link on the other push arm. This provision, however, requires the use of three pivots between the blade, push arms and the adjustable brace or link just back of the blade.

In known angling types of bulldozer blades, tilting of the blade has been accomplished by employing a double swivel joint between the blade and the central portion of the C-shaped frame that will permit tilting about a fore and aft axis as well as angling about the vertical axis, and by providing a sliding connection between the forward end of each adjustable brace or link in the back of the blade along a circular track in a vertical plane. This known construction makes it difficult to mount the blade compactly and securely on the C-shaped frame and requires tilting adjustment at both ends of the blade.

Conventionally, the load handling blade is mounted on the earth moving equipment by means of a central swivel joint, one part of which is attached to the rear of the blade and the companion part is attached to the pusher frame of the earth moving equipment so as to permit up and down movement, pivotal side or angular movement, and edgewise tilting movement of the blade. Various problems occur in the design of such mechanism, particularly when in addition to the angling provision of the blade, tilting of the blade about a longitudinal axis is desired.

One type of prior art construction provides a pair of fluid cylinders attached to the rear of the blade at one end thereof and having their other end attached to the frame of the earth moving equipment, which, when selectively actuated, vary the pitch angle of the blade by pivoting the blade around a vertical axis of the joint relative to the longitudinal axis of the vehicle. Normally, to vary the vertical position of the blade edgewise for tilting, a separate fluid motor has been provided in addition to the fluid motors for angling of the blade.

With this prior arrangement, when the tilting jack is actuated to accomplish vertical tilt adjustment of the blade, the pair of angling jacks are urged to move arcuately in opposite, vertical directions. A problem with the prior art mounting arrangement is that the arrangement is subjected to excessive stresses, and the amount of tilt adjustment of the blade is restricted. It is well-known that earth moving vehicles of this character are subject to considerable shock loads during operation and therefore must be of extremely rugged construction.

When the blade is set at a desired tilt position, such as for forming a ditch or leveling a road, the blade must be capable of maintaining the grade angle selected. With the prior art arrangements of a pair of angling jacks extending substantially horizontally between respective sides of the blade and the C-shaped frame, if the angle of the blade is changed, the tilt must also be readjusted to maintain the same grade angle. This conventional arrangement requires multiple hydraulic control means and multiple fluid power tubing carried by the earth moving vehicle increasing the difficulties in installation of hydraulic power equipment and further increasing the maintenance of the fliud power equipment and complicating the operation of the controls.

Another problem associated with some prior art blade control arrangements is that they have no pitch capability relative to the longitudinal axis of the vehicle. In bulldozers, complete adjustability of the dozer blade renders the vehicle more versatile. These prior constructions have been relatively complex and extremely bulky, and there has been a need for a simplified mechanical construction and controls therefore that permit complete adjustability of the blade.

These disadvantages of present bulldozer constructions have resulted in the blade adjustment construction and controls therefor in the present invention which effectively eliminates the above difficulties of the prior art.

SUMMARY OF THE INVENTION

In accordance with the present invention, an improved mechanical construction and controls are provided for angling, tilting, and pitching the blade which is simplified in construction and provides for angling of the blade without changing the blade tilt.

The blade adjustment construction and controls of the present invention may be utilized in a conventional bulldozer wherein the blade is connected by means of a universal joint to the center bight portion of the C-shaped frame and the lower edge of the blade. The mechanism of the present invention comprises a C-shaped frame including laterally spaced push arms which extend rearwardly between the track frames and which are independently pivoted on transverse axes to the frames. The arms of the C-shaped frame constitute the push arms for the blade, and they are forwardly connected by a transverse cross beam or bight portion extending transversely in front of the vehicle. The blade is raised and lowered by conventional hydraulic actuators supported on opposite sides of the engine housing and having piston rods pivotally connected to the C-shaped frame.

It is the principal object of the invention to provide a vertical mast support structure at the center of the bight portion of the C-shaped frame for mounting one end of the extensible links used for angling, tilting, and pitching the blade. The angling and pitching control includes a pair of piston-cylinders with their piston rod ends connected to the vertical mast and their opposed ends connected to the respective sides of the bulldozer blade. The hydraulic circuitry for the cylinders simultaneously extends the piston rod of one cylinder while retracting the piston rod of the opposing cylinder to angle the bulldozer blade about a vertical axis of the universal joint connecting the blade to the C-shaped frame. Simultaneous extension or retraction of both piston rods causes the blade to pitch about a horizontal axis of the universal joint.

The blade is additionally connected to the top end of the vertical mast structure of the C-shaped frame by means of an extensible tilt link which is disposed parallel to the top edge of the blade. The tilt control includes a piston cylinder with its piston rod end universally pivotally attached to the vertical mast. The vertical pivot axis of the tilt cylinder at the mast is colinear with the vertical pivot axis of the universal joint connecting the blade to the C-shaped frame. The opposed end of the tilt cylinder is universally connected to the blade at a point vertically spaced above the blade attachment point of one of the angle-pitch cylinders. The blade adjustment construction provides that when the blade is angled, the blade tilt is not changed.

The present mechanism is particularly simple in construction, installation, maintenance, and operation and does not require a complex hydraulic system for operation. At the same time it eliminates conventional complex push lever and linkage arrangements.

The present improved integrated hydraulic system combines pitch and angle control by using the same pair of cylinders, and it also combines tilting and lifting into one control. A combination operation is provided in which the operator does not have a plurality of control levers to use as in previous arrangements, and thus, the operator is provided more freedom in the operation of the vehicle without a requirement of plural hand or foot movements to manipulate the many controls of prior equipment.

Other advantages and meritorious features of the blade adjustment construction and controls of the present invention will be more fully understood from the following description of the preferred embodiments, the appended claims, and the drawings. A brief description of which follows.

DESCRIPTION OF THE PREFERRED EMBODIMENT

Figure 1:
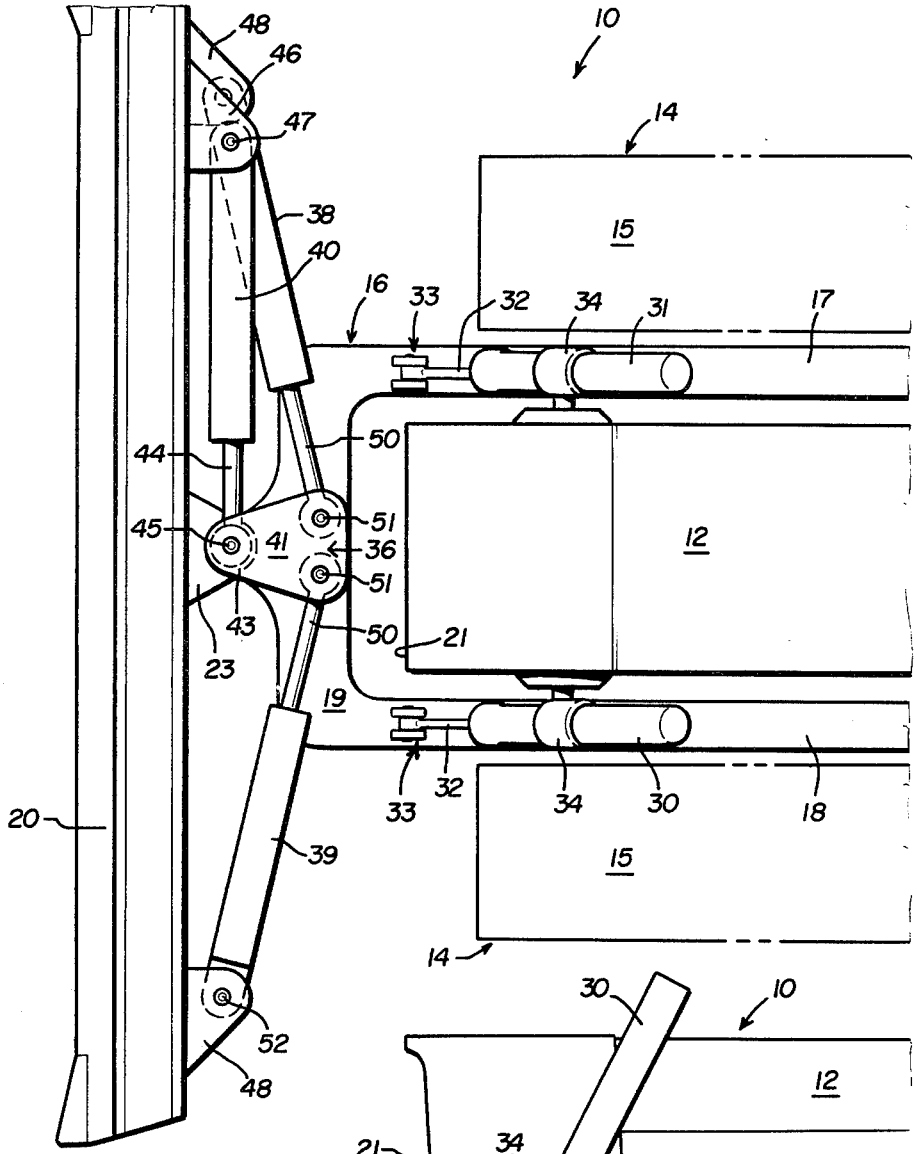
FIG. 1 is a top plan view illustrating the angle-pitch cylinders and tilt cylinder mounted on the vertical mast in an earth-working vehicle embodying the invention.
Figure 2:
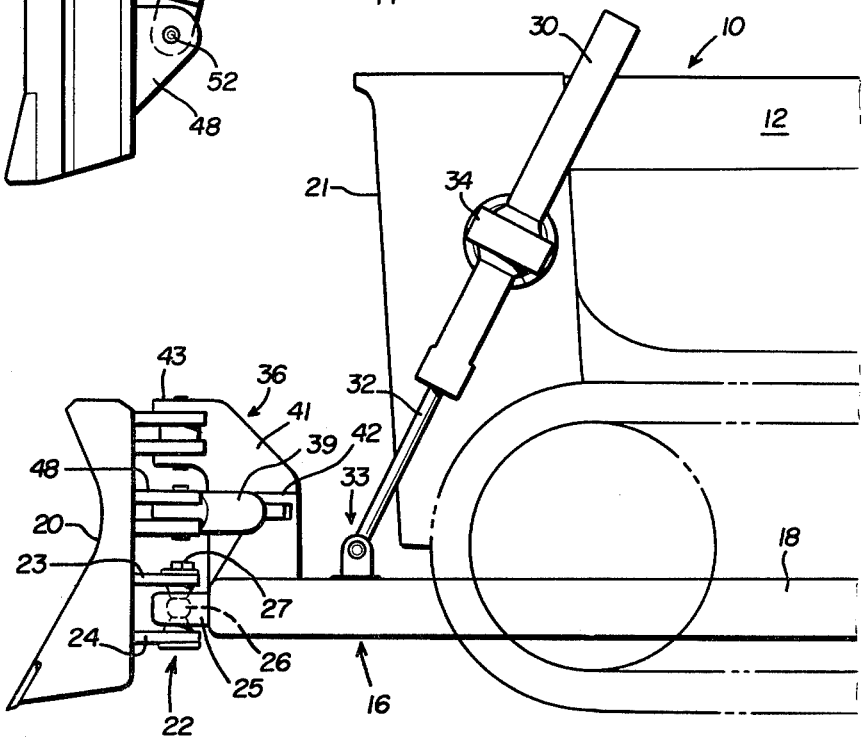
FIG. 2 is a side elevational view of the front part of the vehicle embodying the blade adjustment construction of the present invention.

A preferred embodiment of an earth-working vehicle including an adjustable blade construction and controls made in accordance with the teachings of the present invention as illustrated in FIGS. 1–2. The tractor 10 shown in FIG. 1 is seen to include a main frame 12 flanked by a pair of drive track frames 14. As is well known, track roller assemblies (not shown) may be provided on each of the track frames 14 for engaging track chains 15.

The vehicle 10 carries a frame 16 at the forward end thereof, which is substantially C-shaped in a horizontal plane and includes opposite parallel push arms 17 and 18. The free ends of the opposite parallel arms 17 and 18 extend longitudinally along inner sides of the drive track frames 14 and are pivotally connected thereto by means of transverse axially aligned pivot shafts to enable the frame 16 to be raised or lowered relative to a ground surface on which the vehicle 10 is disposed. The forward ends of the parallel arms 17 and 18 are connected by a transverse bight portion 19.

The bulldozer includes a conventional transverse scraper blade 20 mounted forwardly of the front end 21 of the frame 12. The blade is pivotally supported on the bight portion 19 of the frame 16 by means of a universal swivel joint 22 preferably of the ball and socket type so as to permit universal movement of the blade 20 about a horizontal and a vertical axis within the ball and socket connection.

The ball and socket connection 22 as illustrated in FIG. 2, comprises a horizontally positioned upper ear 23 and a lower ear 24 opposed from each other and projecting from the rear of the blade 20. Each ear 23 and 24 has a vertical bore which is axially aligned with the bore in the opposed ear. An arcuate plate 25 extends forwardly from the center of the bight portion 19 and is positioned between the ears 23 and 24. A swivel ball 26 is mounted on pin 27 within a bore of the arcuate plate 25. The arrangement of the swivel ball 26 allows the rotation of the bulldozer blade 20 about horizontal and vertical axes within the ball and socket connection.

The blade 20 is raised and lowered by conventional hydraulic actuators or lift cylinders 30 and 31 supported on opposite sides of the engine housing and having piston rods 32 pivotally connected by means of clevis type connections 33 mounted on the push arms 17 and 18. The hydraulic lift cylinders 30 and 31 are suitably secured within trunnion mountings 34 mounted to the side walls of the frame 12 such that they have complete freedom of movement in any direction.

FIGS. 1 and 2 illustrate the "f" shaped vertical mast support structure 36 which forms part of the present invention and supports one end of the angle-pitch cylinders 38 and 39 and the tilt cylinder 40. As illustrated, the vertical mast structure 36 extends vertically upwardly from the center of the bight portion 19 of the C-shaped frame 16. The vertical mast has a top end portion 41 which extends outwardly from the forward end of C-shaped frame 16 and is vertically spaced directly above the universal joint 22. Mounting lugs 42 are formed on opposed sides of the vertical mast approximately midway of its longitudinal extent. These mounting lugs secure one end of the respective angle-pitch cylinders 38 and 39. The cantilevered top end portion 41 is also provided with a mounting portion 43 for securing one end of the tilt cylinder 40.

The tilt cylinder 40 is disposed parallel to the upper end of the blade 20, and it has a rod end 44 universally pivotally secured to mounting portion 43 of vertical mast 36 by pin 45. Its opposite end is universally pivotally mounted to lugs 46 welded on the back side of blade 20 by pin 47. The pivot axis 45 of tilt cylinder 40 is directly above and colinear with the vertical pivot axis defined by the universal swivel connection 22 about pin 27. Pivot axis 45 is directly above the universal joint 22 so that a set grade angle is not changed by angling of the blade 20. Once the operator sets the tilt of the blade, the blade can be angled without requiring a readjustment of tilt cylinder 40 to recapture the desired grade angle.

The angle-pitch controls illustrated in FIGS. 1–2 include one piston-cylinder 38 on the left hand side of the bulldozer blade and a second cylinder 39 identical in construction, mounting and operation to the first, on the right-hand side of the blade. The cylinders are connected between mounting lugs 48 welded on the backside of the blade and mounting lugs 42 on the vertical mast support structure 36. The piston rod 50 of each angle-pitch cylinder is universally pivotally connected by a vertical pin 51 to the mounting lugs 42 on the vertical mast structure, and the opposite end of each angle-pitch cylinder is universally pivotally mounted to lugs 48 on the back of blade 20 by vertical pin 52.

The angle-pitch motors 38 and 39 are controlled by a control valve 56 and diverter valve 58 (FIGS. 3–6) which are manipulated for placing the angle-pitch cylinders in series or parallel. When the cylinders are placed in series, the piston rod of one angle-pitch cylinder is extended and the piston rod of the other cylinder is retracted to adjust the angle of the dozer blade 20 relative to the vertical axis defined by the swivel connection 22. The control valve and diverter valve may also be manipulated to connect the cylinders in parallel whereby both piston rods are extended or both are retracted, in unison, for pitching the blade relative to the horizontal axis defined by the swivel connection 22.

The tilt control is adjustable such that as piston rod 44 is extended outwardly from tilt cylinder 40, a downward push is exerted on the upper edge of the blade 20 nearest to the piston rod and an upward pull is exerted on the lower edge of the blade, diagonally positioned therefrom to rotate the blade about the longitudinal axis of the universal swivel 22 tilting the blade to the right. Conversely, when the piston rod 44 is retracted within the tilt cylinder 40, the blade 20 is caused to rotate around a longitudinal axis of the universal swivel joint 22 in the opposite direction tilting the blade to the left.

The present invention requires no complex hydraulic circuitry or linkage arrangements to accomplish the desired blade adjustments. By the present arrangement the blade 20 can be tilted without angling the blade; angled without tilting the blade; or angled and tilted in a plurality of positions. It is a principal feature of the present invention that when the blade 20 is tilted to a certain position, the change in the blade angle does not change the blade tilt.

Referring to FIGS. 3–8, the hydraulic circuitry illustrated has pressure fluid source, such as pump 62 with its inlet 63 connected to a reservoir 64. The pump 62 supplies fluid under pressure to its outlet denoted generally at 65.

The hydraulic circuit for angling and pitching the blade is illustrated in FIGS. 3–6, and the circuit includes a control valve 56 and a diverter valve 58. The control valve is conventional and may be described as a manually operated, four-way, three position spool type valve which is provided with a spring return of the spool to a neutral position. The diverter valve 58 is also conventional, and it has a pressure balanced spool with several positions of the spool selected by manual operation such that it enables the user to operate two double acting cylinders with one four-way control valve and direct flow in a hydraulic system to two separate hydraulic lines.

Connected to the outlet 65 of pump 62 is manually operable angle-pitch control valve 56 as illustrated in FIGS. 3–6. The angle-pitch control valve 56 is adjustable to connect the pump outlet 65 to either of the control ports 68 and 69 of the control valve 56. In a neutral state of the control valve, the control ports 68 and 69 are closed and the flow from pump 62 to tank 64 is through the open center of the control valve 56 thereby having no effect upon the angle-pitch cylinders 38 and 39.

The angle-pitch control valve 56 can be adjusted to supply pressure fluid by way of control port 68 while connecting the other control port 69 to the reservoir 64 by way of a discharge line 70. The diverter port 72 is at the same time in a position to connect one of the angle-pitch cylinders 50 by way of port 68 to the fluid pressure from pump 62. The rod ends 50 of the motors are connected by an interconnecting line, and fluid pressure from pump 62 will pass through port 68 of control valve 56 and through port 72 of diverter valve 58 to angle-pitch cylinder 39. The two cylinders 38 and 39 are placed in series with the pressure flow extending piston 39 to the left and retracting piston 38 to the right. This causes the blade 20 to be angled to the right.

During angling of the blade 20 to the right, the return flow of fluid will be from cylinder 38 to reservoir 64 by way of port 69 in the control valve 56. In the angle position of the diverter valve 30 illustrated in both FIGS. 3 and 4, the passageways indicated by dotted lines are blocked at valve 58 and are not operative.

Figure 3:
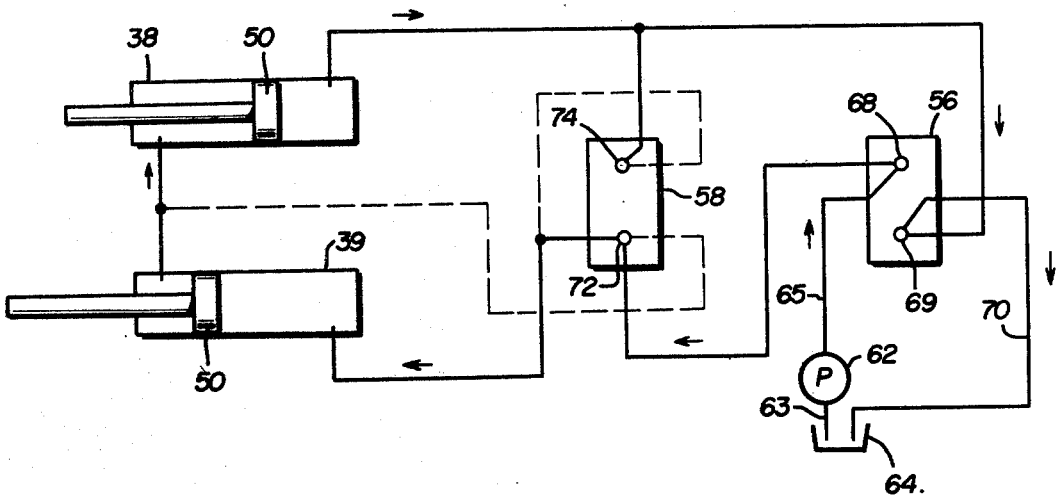
FIGS. 3–4 are schematic illustrations of the hydraulic system of the present invention with associated hydraulic components being indicated in dot and dash lines showing the hydraulic system for angling the blade.
Figure 4:
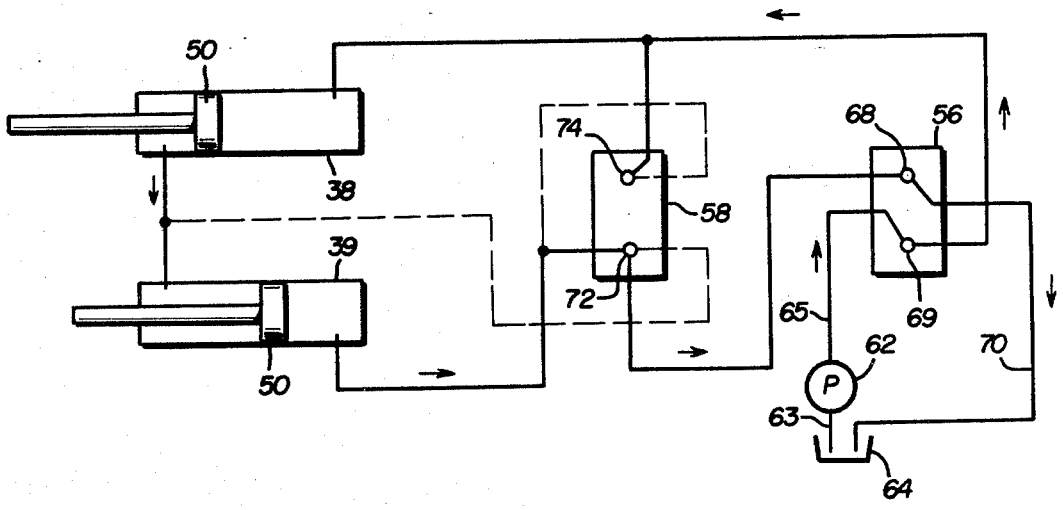

As illustrated in FIG. 4, the angle-pitch cylinders are also in series connection, but this time, the fluid pressure flow is in the reverse direction from the flow illustrated in FIG. 3 and the right hand piston-cylinder 38 is extended and the left hand piston-cylinder 39 is retracted so that the blade 20 will be angled to the left. As illustrated, port 69 of control valve 56 is open to the fluid pressure from pump 62, and port 68 is open to the reservoir 64. Port 72 of the diverter valve connects port 68 of the control valve to angle-pitch cylinder 39, and port 74 of the diverter valve is closed. The fluid pressure from pump 62 is transmitted through port 69 in control valve 56 to cylinder 38 and in series therewith to cylinder 39 to extend cylinder 38 and retract cylinder 39 which angles the blade 20 to the left. Return fluid flow will be from cylinder 39 through port 72 of diverter valve 58 and through port 68 of control valve 56 to receiver tank 64.

Figure 5:
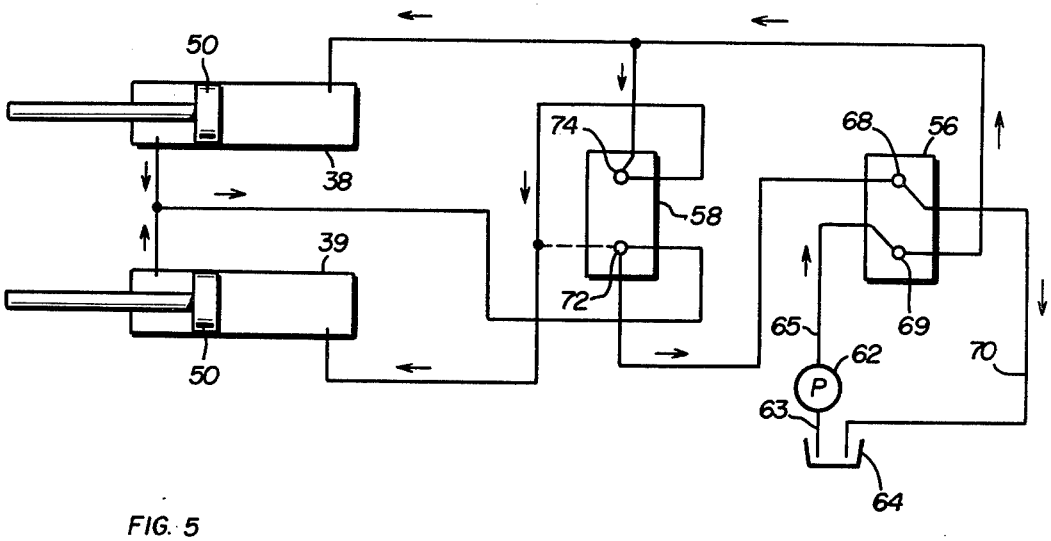
FIGS. 5–6 are schematic illustrations of the hydraulic system of the present invention with associated hydraulic components being indicated in dot and dash lines and showing the hydraulic system for pitching the blade.

Referring to FIG. 5, the control valve 56 and diverter valve 58 are manipulated so that the angle-pitch cylinders 38 and 39 are connected in parallel such that their piston rods 50 are extended which will cause the blade 20 to pitch forwardly about the horizontal axis defined by the swivel connection 22. In this arrangement, port 69 of the control valve 56 is open to fluid pressure from pump 62, and port 68 is open to the reservoir 64 and to port 72 of diverter valve 58. Diverter valve port 72 connects port 68 to the rod side of both piston-cylinders 38 and 39. Port 74 of the diverter valve 58 connects the head side of both cylinders to pump 62 by way of control valve port 69. The pressurized flow from pump 62 passes through control valve port 69 to cylinder 38 and, by way of diverter valve port 74 to cylinder 39, both cylinders being in parallel. The piston rods 50 and both cylinders 38 and 39 will be extended, and this will cause the blade 20 to pitch forwardly.

Figure 6:
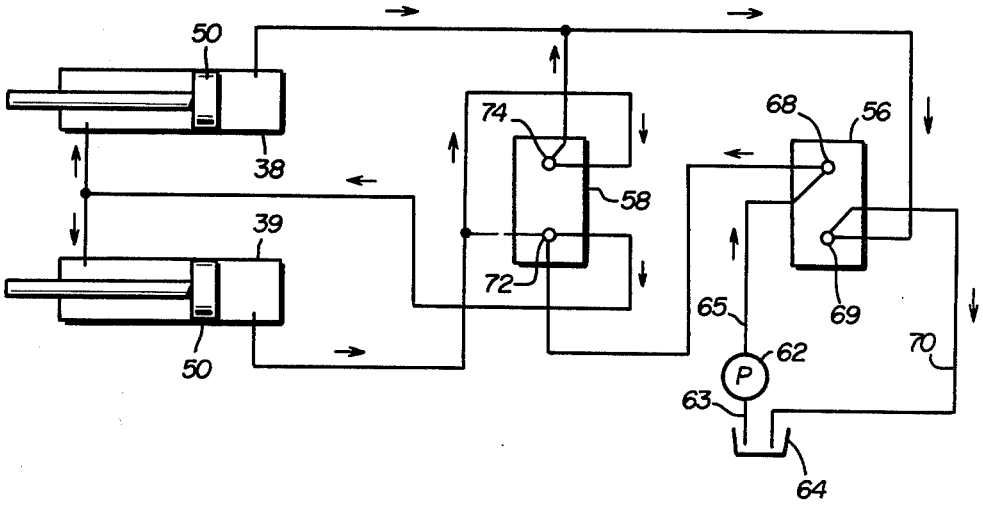

In the pitch position as illustrated in FIGS. 5 and 6, the short passage interconnecting the fluid line from the right hand end of cylinder 39 with port 72 of the diverter valve, is blocked by diverter valve 58, and is therefore indicated by dotted lines. Return flow of the fluid as illustrated in FIG. 5 will be from the rod ends of both cylinders 38 and 39 to diverter valve port 72, control valve port 68, and reservoir 64.

Referring to FIG. 6, the angle-pitch cylinders 38 and 39 are connected in parallel, but the fluid pressure flow is reversed thereby causing both cylinders to be retracted for pitching the blade 20 rearwardly about the horizontal axis defined by the swivel connection 22. The control valve port 68 is open to fluid pressure from pump 62, and the control valve port 69 is open to reservoir 64 for discharge. Diverter valve port 72 connects control valve port 68 to the rod side of both angle-pitch cylinders 38 and 39, and diverter valve port 74 connects the head side of both cylinders 38 and 39 to reservoir 64 by way of control valve port 69. Fluid pressure from pump 62 is transmitted by way of control valve port 68 through diverter valve port 72 and into the rod ends of both cylinders 38 and 39 to simultaneously retract both cylinders in unison for pitching the blade 20 rearwardly. The return flow from the two cylinders 38 and 39 from their head ends passes to reservoir 64 by way of diverter valve port 74 and control valve port 69.

Figure 7:
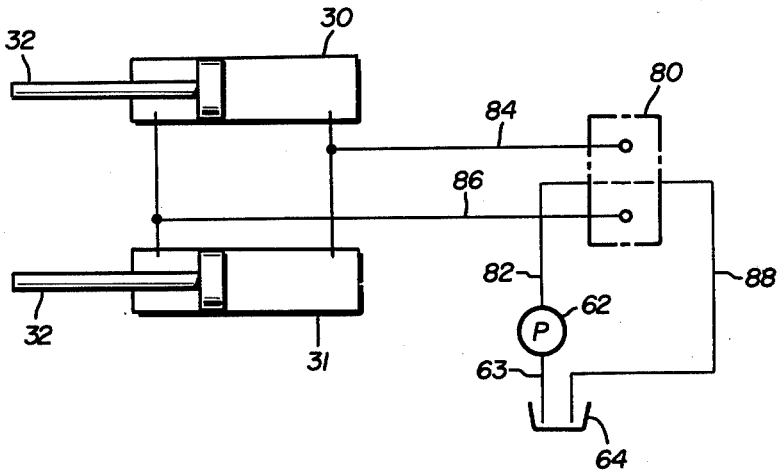
FIG. 7 is a schematic illustration of the hydraulic system for lifting the blade.

A manually adjustable lift motor control valve 80 is illustrated in FIG. 7, and it connects the outlet 82 of the pump 62 to either a supply line 84 extending to the head ends of the lift cylinders 30 so as to lower the dozer blade 20 or to the rod ends by way of a supply line 86 to raise the dozer blade 20. When the head ends of the lift motors 30 are supplied with pressure fluid, their rod ends are connected by the lift motor control valve 80 to the discharge line 88. In the neutral setting of the lift motor control valve 80, connection between the lift motors 30 and the pump 62 is disrupted. In the so-called float position, the control valve 80 connects both the rod ends and the head ends of the lift motors 30 to the discharge line 88 and blocks or cuts off the communication with pump outlet 82.

Figure 8:
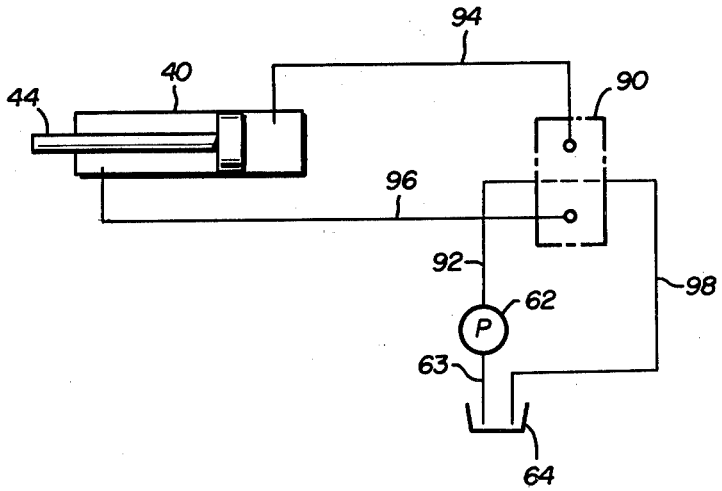
FIG. 8 is a schematic illustration of the hydraulic system for tilting the blade.

Referring to FIG. 8, a manually operable tilt control valve 90 is shown connected to the outlet 92 of pump 62. This tilt control valve 90 is adjustable to connect the outlet 92 to either a supply line 94 extending to the head end of the tilt motor or to a supply line 96 extending to the rod end of the tilt motor. The tilt motor control valve 90 can also be moved to its neutral setting and disconnect the supply line 92 from both the pump outlet and discharge line 98. Thus, as piston rod 56 is extended outwardly from tilt cylinder 40, a downward push will be exerted on the upper edge of the blade 20 nearest to the piston rod and an upward pull is exerted on the lower edge of the blade diagonally positioned therefrom to thereby rotate the blade about the longitudinal axis defined by the universal swivel joint 22 tilting the blade to the right. Conversely, when the piston rod 56 is retracted within the cylinder 40, the blade is caused to rotate about the longitudinal axis of the universal joint 22 in the opposite direction tilting the blade to the left.

The present hydraulic system provides both pitch and angle setting of the blade by means of the same pair of hydraulic cylinders 38 and 39 which considerably facilitates installation requirements and maintenance of the hydraulic system. The construction permits a single control lever be used for actuation of both pitch and angle settings of the blade whereby the operator of the equipment does not have to move his hand from the control lever or use another hand or foot for operation as in previous arrangements. The angle-pitch cylinders 38 and 39 are placed in series or parallel as desired for enabling the pistons of the cylinders to be extended simultaneously or retracted simultaneously for pitching. One of the angle-pitch cylinders may be extended while the other is retracted or one retracted while the other is extended, all for the purpose of enabling the dozer blade 20 to be angled as desired. Thus, the operator is provided with more freedom in the operation of the equipment in that the angling and pitching control for the blade 20 requires only one control lever.

The present invention also provides that the lift cylinders and tilt cylinder be actuated by a single control lever. An example of an apparatus for combining two movement controls for a blade into one control lever is illustrated in U.S. Pat. No. 3,705,631, assigned to the assignee of the present invention, which disclosure is incorporated herein by reference. An improved hydraulic control system is provided for a load handling implement and particularly for positioning the dozer blade 20 in various directions around the intersecting axes of universal swivel joint connection 22. When the blade is set at a desired tilt position, such as for forming a ditch or leveling a road, the angle of the blade may be changed and not affect the tilt. The tilt position will not have to be readjusted in order to maintain the same grade angle that was originally set. This improved arrangement facilitates the handling of the equipment by the operator of the machine by the provision of only two control levers being utilized for angling, pitching, tilting and lifting the blade.

It will be apparent to those skilled in the art that the foregoing disclosure is exemplary in nature rather than limiting, the invention being limited only by the appended claims.

I claim:

1. In an earth-working vehicle, a frame comprising a generally C-shaped structure having opposed arms, the free ends of said arms being connected to said vehicle, the other ends of said arms being connected by a transverse cross beam, a ground engaging blade, means for universally mounting said blade on the forward end of said transverse cross beam, the improvement comprising:

a vertical mast upstanding from said transverse cross beam, an angling and pitching control for said blade including a pair of longitudinally movable links pivotally connected at one of their ends to said vertical mast and their opposed ends pivotally connected to respective sides of said blade, first control means having two modes of operation, in a first mode said first control means extending one of said movable links and retracting the opposed link to angle the blade about a vertical axis of said blade universal mounting means, in a second mode said first control means simultaneously extending said movable links to pitch said blade forwardly about the horizontal axis of said blade universal mounting means or simultaneously retracting said movable links for pitching said blade rearwardly about said horizontal axis of said blade mounting means, a tilt control for said blade including a third extensible link disposed generally parallel to the top edge of said blade and universally pivotally attached at one end to mounting means on said vertical mast and at its other end to mounting means on one side of said blade at a point vertically spaced above the blade attachment point of one of said longitudinally movable links, and second control means for extending and retracting said third extensible link causing said blade to rotate around a longitudinal axis of said blade universal mounting means to thereby tilt said blade about said longitudinal axis.

2. The blade adjustment mechanism as defined in claim 1 wherein said third extensible link for tilting said blade is universally pivotally mounted to said mounting means on said vertical mast for pivotal movement about a vertical axis that is colinear with the vertical pivot axis of said blade universal mounting means.

3. The blade adjustment mechanism as defined in claim 2 wherein said vertical mast has a generally vertical portion and a cantilevered portion that extends forwardly of said transverse cross beam, said mounting means on said vertical mast for said third extensible link being formed on said cantilevered portion directly above said blade universal mounting means.

4. The blade adjustment mechanism as defined in claim 1 wherein said pair of longitudinally movable links comprise fluid actuated piston-cylinders.

5. The blade adjustment mechanism as defined in claim 4 wherein said first control means for controlling angling and pitching of said blade comprises a source of fluid pressure, an exhaust conduit, a diverter valve for selecting the angle and pitch functions, a control valve for selecting the direction of angle and pitch, whereby both angle and pitch functions are controlled with said pair of fluid cylinders, said diverter valve, and said control valve, with the exhausting end of one fluid cylinder supplying pressurizing fluid to the corresponding end of the other fluid cylinder by a linking conduit when said diverter valve is in its angle position, and with a first pair of corresponding ends of said fluid cylinders being simultaneously pressurized and a second pair of corresponding ends of said fluid cylinders being simultaneously exhausted, as controlled by said control valve, when said diverter valve is in its pitch position.

6. The blade adjustment mechanism as defined in claim 5 wherein a first control lever is utilized by an operator to operate the angling and pitching controls for the blade and a second control lever is utilized by the operator to operate the lift and tilt controls for the blade.

7. A tilting, angling, and pitching mechanism for the blade of an earth-moving vehicle having a blade supporting frame, said frame being of substantially C-shaped configuration comprising a pair of parallel arms pivotally connected to said vehicle at their free ends and a transverse bight portion connecting the other ends of said arms in front of said vehicle, said transverse bight portion supporting a material moving blade, means to universally pivotally connect said blade to said bight portion at the center thereof midway between the ends of said blade and adjacent the lower edge thereof to permit angular adjustment of said blade about intersecting vertical, horizontal, and longitudinal axes, a vertical mast upstanding from said transverse bight portion, a pair of longitudinally movable links pivotally connected at one of their ends to said vertical mast and their opposed ends pivotally connected to respective sides of said blade, said pair of links being individually, longitudinally adjustable to thereby cause angling of said blade about a vertical axis when said links are longitudinally moved in opposite directions and to cause pitching of said blade about a horizontal axis when said links are longitudinally moved in the same direction, an extensible link disposed generally parallel to the top edge of said blade and universally pivotally attached at one end to mounting means on said vertical mast and at its other end to mounting means on one side of said blade at a point vertically spaced above the blade attachment point of one of said pair of links so that upon selective extension or contraction of said extensible link said blade will be tilted about an axis longitudinally of said vehicle and intersecting said vertical axis and horizontal axis within said universal pivoting means.

8. In an earth-working vehicle, a frame comprising a generally C-shaped structure having opposed arms, the free ends of said arms being connected to said vehicle, the other ends of said arms being connected by a transverse cross lmember, a ground engaging blade, means for universally mounting said blade on the forward end of said transverse cross member, the improvement comprising:

a vertical structure upstanding from said transverse cross beam adjacent the mid-portion, an angling and pitching control for said blade including a pair of extensible and retractable piston-cylinders pivotally connected at one of their ends to said vertical structure and their opposed ends pivotally connected to respective sides of said blade, said pivotal connections for said piston-cylinders being spaced vertically above said blade universal mounting means, control means having two modes of operation, in a first mode said control means extending one of said piston-cylinders and retracting the opposed piston-cylinder to angle the blade about a vertical axis of said blade universal mounting means, in a second mode said control means simultaneously extending both said piston-cylinders to pitch said blade forwardly about the transverse horizontal axis of said blade universal mounting means or simultaneously retracting both said piston-cylinders for pitching said blade rearwardly about said transverse horizontal axis of said blade mounting means.

9. The blade adjustment mechanism as defined in claim 8, a tilt control for said blade including a third piston-cylinder disposed generally parallel to the top edge of said blade and universally pivotally attached at one end to mounting means on said vertical structure and at its other end to mounting means on one side of said blade at a point vertically spaced above the blade attachment point of one of said pair of piston-cylinders, and second control means for extending and retracting said third piston-cylinder causing said blade to rotate around a longitudinal axis of said blade universal mounting means to thereby tilt said blade about said longitudinal axis.

10. The blade adjustment mechanism of claim 8 wherein the pivotal axes on said vertical structure for said pair of piston-cylinders are rearwardly of said blade universal mounting means.

11. In an earth-working vehicle, a frame comprising a generally C-shaped structure having opposed arms, the free ends of said arms being connected to said vehicle, the other ends of said arms being connected by a transverse cross beam, a ground engaging blade, means for universally mounting said blade on the forward end of said transverse cross beam, the improvement comprising:

a vertical mast upstanding from said transverse cross beam, an angling and pitching control for said blade including a pair of extensible and retractable piston-cylinders pivotally connected at one of their ends to said vertical mast at approximately mid-way of its longitudinal extent and their opposed ends pivotally connected to respective sides of said blade, said vertical mast being generally "f" shaped and the pivotal axes on said vertical structure for said pair of piston-cylinders are rearwardly of said blade universal mounting means.

12. The vertical mast as defined in claim 11 including a mounting connection at its top end defining a vertical pivot axis that is directly above said blade universal mounting means and said vertical axis being colinear with the vertical pivot axis of said blade mounting means.

* * * * *